US012698634B2

(12) United States Patent
Sholka et al.

(10) Patent No.: US 12,698,634 B2
(45) Date of Patent: Aug. 4, 2026

(54) RAILING CONNECTOR SYSTEM AND METHOD OF INSTALLING RAILING

(71) Applicant: Key-Link Fencing & Railing, Inc., New Holland, PA (US)

(72) Inventors: Aleksey A. Sholka, Lancaster, PA (US); Michael A. Alexander, Smoketown, PA (US); Jared C. Detweiler, York, PA (US); Austin S. Nace, Pottstown, PA (US)

(73) Assignee: PrimeSource Building Products, Inc., Irving, TX (US)

( * ) Notice: Subject to any disclaimer, the term of this patent is extended or adjusted under 35 U.S.C. 154(b) by 577 days.

(21) Appl. No.: 18/159,382

(22) Filed: Jan. 25, 2023

(65) Prior Publication Data

US 2024/0247492 A1 Jul. 25, 2024

(51) Int. Cl.
*E04F 11/18* (2006.01)
*E04H 17/14* (2006.01)

(52) U.S. Cl.
CPC ..... *E04F 11/1812* (2013.01); *E04F 11/1834* (2013.01); *E04H 17/1448* (2021.01); *E04F 2011/1821* (2013.01)

(58) Field of Classification Search
CPC ..... E04H 17/1448; E04F 11/1834; E04F 2011/1821; E04F 2011/1827; E01F 11/1834; E01F 2011/1821; E01F 2011/1827
See application file for complete search history.

(56) References Cited

U.S. PATENT DOCUMENTS

| | | | | |
|---|---|---|---|---|
| 5,437,433 A * | 8/1995 | Rezek | E04F 11/1834 | 256/67 |
| 5,584,469 A * | 12/1996 | Goodwin | E04F 11/1834 | 256/65.02 |
| 7,540,472 B2 * | 6/2009 | Striebel | E04F 11/1817 | 256/65.15 |
| 8,757,566 B2 * | 6/2014 | Nash | E04F 11/1808 | 403/174 |
| 9,637,932 B2 * | 5/2017 | Schneider | E04H 17/1417 | |
| 10,294,674 B2 * | 5/2019 | Guo | E04H 17/1417 | |
| 10,947,738 B2 * | 3/2021 | Loh | E04F 11/1834 | |

FOREIGN PATENT DOCUMENTS

| | | | | |
|---|---|---|---|---|
| DE | 295 03 235 | * | 6/1995 | E04F 11/1834 |
| KR | 10-0633417 | * | 8/2004 | E04F 11/18 |

* cited by examiner

*Primary Examiner* — Michael P Ferguson
(74) *Attorney, Agent, or Firm* — Saxton & Stump, LLC

(57) ABSTRACT

A railing connector system having a variable height adjustment and pivoting for installation of railing and various angles and heights. The railing connector system includes a receiver configured to receive one or more railing segments. The receiver includes a support surface that receives a pivot surface of a pedestal member. The pedestal member is configured to pivotably engage the support surface. The railing connector system further includes an adjustment member extending through a passageway of the pedestal member and a base plate threadedly engaged with the adjustment member. A lift feature is arranged and disposed at a fixed location along the length of the adjustment member. The lift feature is engaged with the pedestal member to move the pedestal member. Actuation of the adjustment member increases or decreases the distance between the lift feature and the base plate to lower or raise the pedestal.

12 Claims, 8 Drawing Sheets

RAILING CONNECTOR SYSTEM AND METHOD OF INSTALLING RAILING

FIELD OF THE INVENTION

The present disclosure is generally directed to railing connector systems. In particular, the present disclosure is a railing connector system for metal fencing that is able to be easily installed in various configurations.

BACKGROUND OF THE INVENTION

Installing aluminum railing, particularly around stairs or on uneven ground, can be a difficult task. For example, known solutions for installing railing on stairs and uneven ground include cutting and measuring individual post members to specific sizes corresponding to the pitch of the railing. If the measurements are off or the railing angle needs to be adjusted, the posts must be individually measured and cut. Other known connector systems are sized specifically for a particular height or angle. However, these solutions require the installer to carry a large number of different sizes and angles, resulting in significant inventory issues, to address particular installations. In addition, due to the limitations of the known system, the post member positioning on the stair tread is restricted.

What is needed is a railing connector system that provides installation in various configurations, including heights and angles, that is easy to install and does not suffer from the drawbacks of known railing connector systems. Other features and advantages will be made apparent from the present specification. The teachings disclosed extend to those embodiments that fall within the scope of the claims, regardless of whether they accomplish one or more of the aforementioned needs.

SUMMARY OF THE INVENTION

The present disclosure is directed to a railing connector system having a variable height adjustment and pivoting for installation of railing at various angles without the need for removal, measuring and/or cutting.

One embodiment of the present disclosure includes a railing connector system. The railing connector system includes a receiver configured to receive one or more railing segments. The receiver includes a support surface that receives a pivot surface of a pedestal member. The pedestal member is configured to pivotably engage the support surface. The railing connector system further includes an adjustment member extending through a passageway of the pedestal member and a base plate threadedly engaged with the adjustment member. A lift feature is arranged and disposed at a fixed location along the length of the adjustment member. The lift feature is engaged with the pedestal member to move the pedestal member. Actuation of the adjustment member increases or decreases the distance between the lift feature and the base plate to lower or raise the pedestal.

Another embodiment of the present disclosure includes a method for installing railing. The method includes providing a railing connector system having a height adjustable and pivotable receiver. The railing connector system is directed onto a support member and one or both of a height and an angle of the receiver is adjusted. A railing segment is directed into the receiver and is secured to the receiver.

Other features and advantages of the present invention will be apparent from the following more detailed description of the preferred embodiment, taken in conjunction with the accompanying drawings which illustrate, by way of example, the principles of the invention.

BRIEF DESCRIPTION OF DRAWINGS

Wherever possible, the same reference numbers will be used throughout the drawings to represent the same parts.

DETAILED DESCRIPTION OF THE INVENTION

A railing connector system according to the present disclosure provides for easy installation in various configurations, including, but not limited to stairs, angles and uneven ground. In certain embodiments of the present disclosure, the railing connector system according to the present disclosure may have its height adjusted with conventional tools accessed while the railing connector system is installed. In addition, railing connector system may be pivoted to accommodate railing at angles to the post member. Further, the railing connector system according to the present disclosure reduces or eliminates the need to perform field cuts to the post member or railing during installation.

Figure 1:
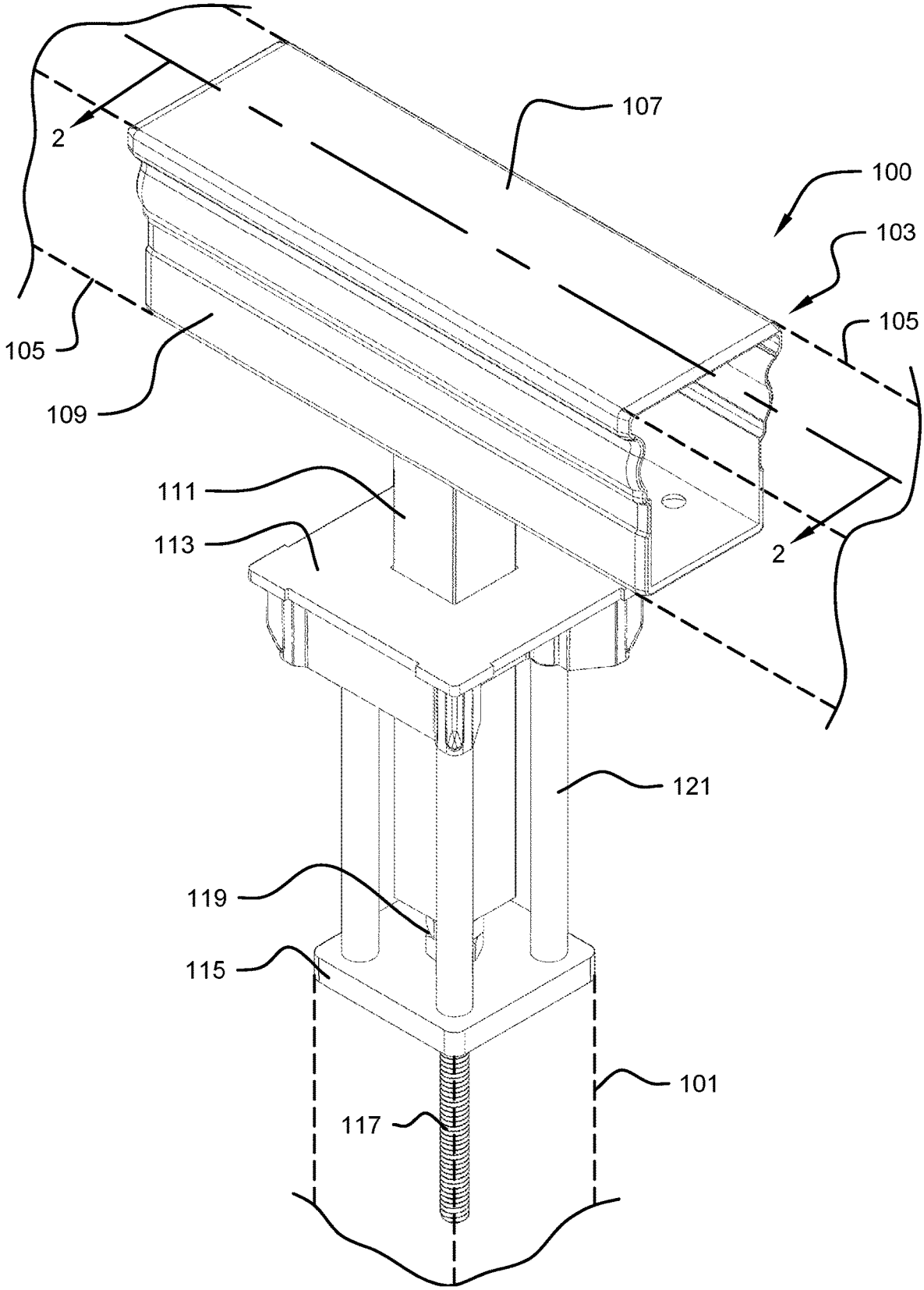
FIG. 1 shows a perspective view of the railing connector system according to an embodiment of the present disclosure.

FIG. 1 shows a railing connector system 100 according to an embodiment of the present disclosure. The railing connector system 100 is installed on a support member 101 (shown in broken lines). Support member 101 may include any suitable support structure for installation of a railing, such as extruded or cast metal posts. However, the support member 101 is not so limited and may be fabricated from any suitable material, such as, but not limited to wood, composite, polymer, aluminum, steel, or zinc. The railing connector system 100 includes receiver 103 configured to receive one or more railing segments 105 (shown in broken lines). In one embodiment, the receiver 103 is configured to receive one or more railing segments 105 from distal ends of the receiver. In one embodiment, the railing is an extruded or cast aluminum railing. Like the support member 101, the railing segments 105 may be fabricated from any suitable material known for railing applications. For example, railing segments 105 may be fabricated from wood, composite, polymer, aluminum, steel, or zinc. Receiver 103 includes a cap 107 and a guide member 401 (see also FIG. 4) installed on a segment connector 109. Segment connector 109 may include a lip or other mechanical feature that clips or otherwise retains the cap 107 in position. The support member 101 and the railing segments 105 may be fabricated from the same material or may be different materials. The segment connector 109 includes a geometry that corresponds to or otherwise is capable of receiving the geometry of the railing segments 105 and may be secured in place by fasteners or other securing method. In one embodiment, segment connector 109 includes fastener openings 301 (see FIG. 3) that permit securing of the railing segments 105 from underneath the segment connector 109. Fastener openings 301 permit securing of the railing segments with fasteners, such as screws, driven through fastener openings 301.

Figure 2:
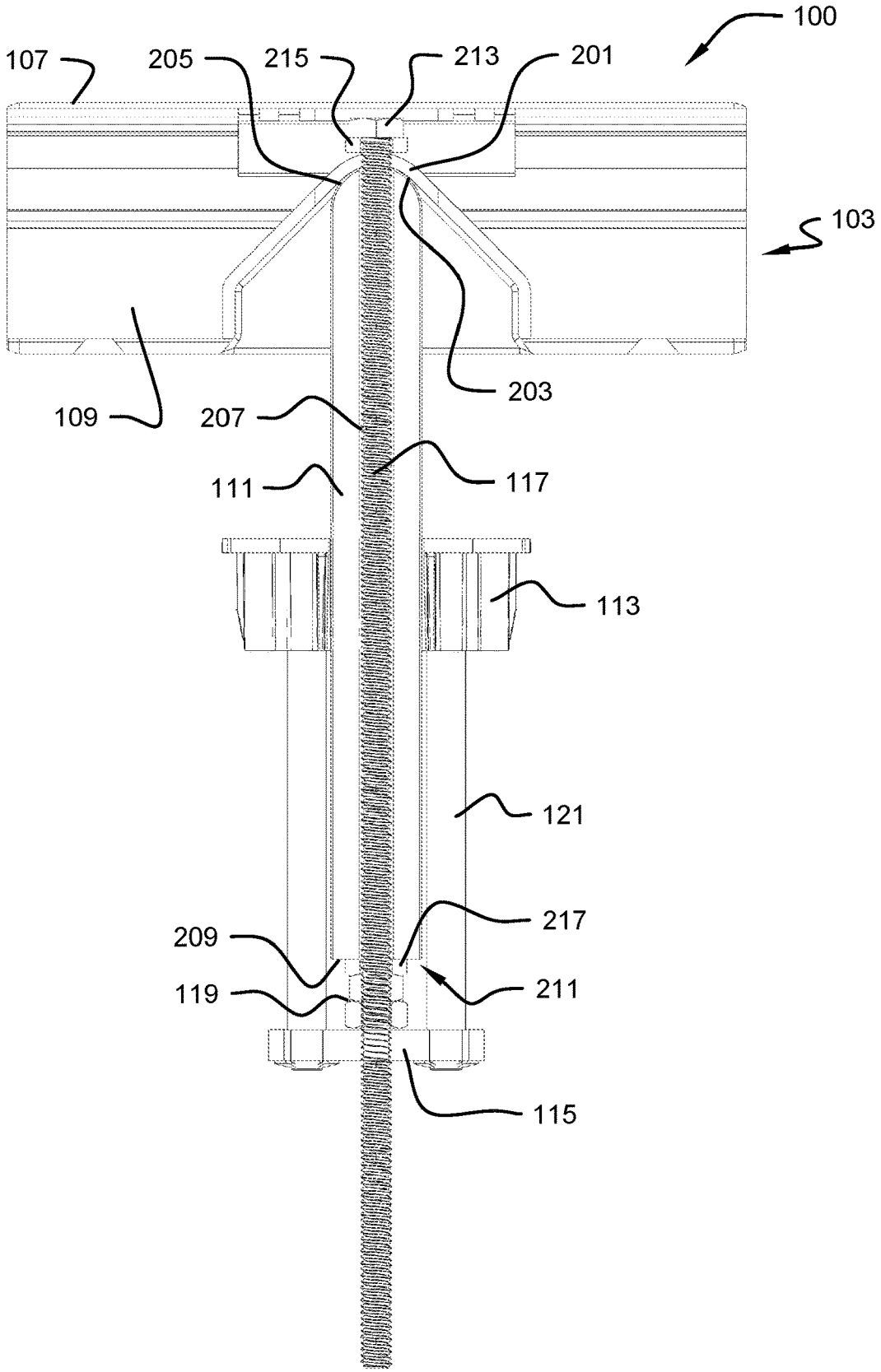
FIG. 2 shows a cutaway view of the railing connector system taken in direction 2-2 of FIG. 1.
Figure 3:
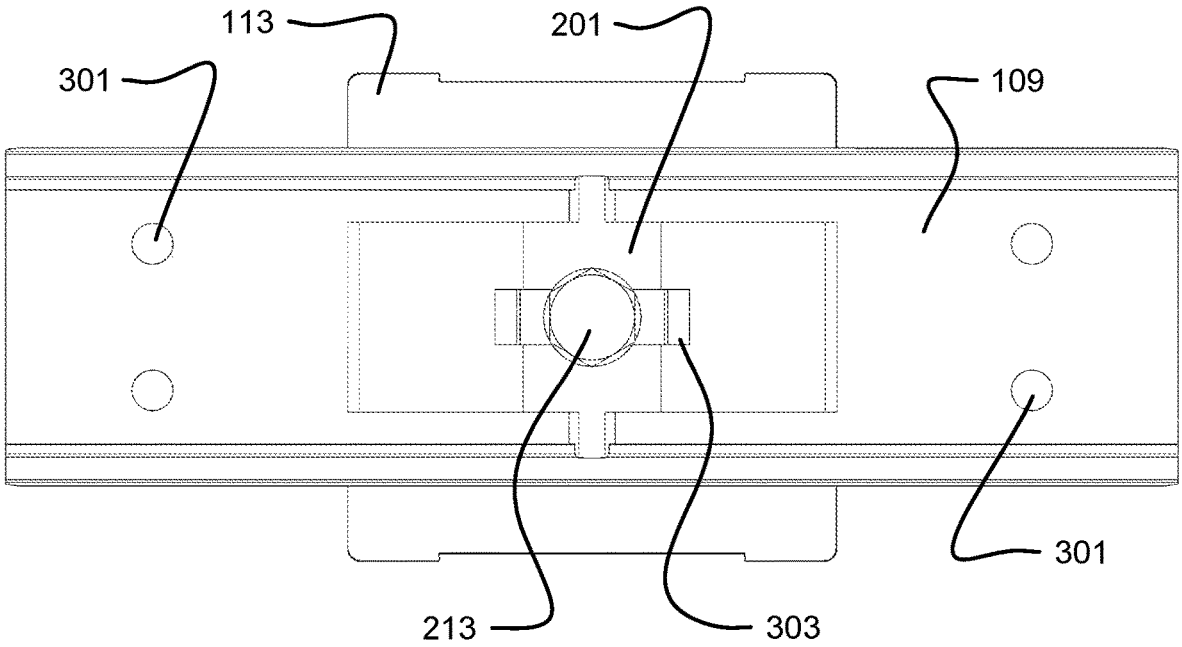
FIG. 3 shows a top view of the railing connector system of FIG. 1 with the cap and guide member removed.

The railing connector system 100 according to the present disclosure includes a pedestal member 111 extending from the receiver 103 through a post connector 113 toward a base plate 115. The pedestal member 111 slides within the post connector 113 to extend or retract the pedestal member 111 to adjust the height of the receiver 103. Height, as utilized herein, refers to the distance that the receiver 103 is positioned from the post connector 113 and is not dependent upon or limited to any particular orientation of the railing connector system 100. As shown in FIG. 2, the segment connector 109 of receiver 103 includes a receiver support feature 201 having a support surface 203. The receiver support feature 201 is positioned and secured within the segment connector 109 to pivotably engage the pedestal member 111 at the support surface 203 and allow pivoting or otherwise rotating with respect to each other. The pivoting or rotating permit the segment connector 109 to be oriented at various angles to the pedestal member 111. For example, in one embodiment, the segment connector 109 may be at an angle up to 36 degrees to the pedestal member 111. In the embodiment shown in FIG. 2, support surface 203 engages pedestal member 111 at a curved pivot surface 205. Each of the support surface 203 and the pivot surface 205 have a geometry that allows the pivoting or rotating of the segment connector 109 and receiver 103 with respect to the pedestal member 111 and restricts motion of the pedestal member 111 within the segment connector 109 and receiver 103. Pedestal member 111 includes a passageway 207 that extends therethrough from the pivot surface 205 to a lift surface 209 at a distal end 211. The pedestal member 111 is configured to pivotably engage the support surface 203. By pivotably engage, it is meant that the support surface 203 and the pivot surface 205 are in contact and engage to permit positioning of the pedestal member 111 at angles to the receiver 103. However, the motion between the segment connector 109 and the pedestal member 111 is restricted to a pivoting motion, where the lateral motion of the pedestal member 111 within the segment connector 109 is restricted. As shown in FIGS. 2 and 3, receiver support feature 201 includes a slot 303 that permits the pivoting of the pedestal member 111 within the segment connector 109 by allowing a sliding motion of a drive head 213 and upper washer 215 along the surfaces of receiver support feature 201 adjacent to slot 303.

An adjustment member 117 extends through passageway 207 of pedestal member 111 and is threadedly engaged with base plate 115. By threadedly engaged, it is meant that threads of the adjustment member 117 are in contact with threads of the base plate 115 in a manner that permits movement of adjustment member 117 with respect to the base plate 115 upon rotation of the adjustment member 117. In one embodiment, the adjustment member 117 is a threaded bolt or screw. However, the adjustment member 117 is not so limited and may include other elongated structures capable of providing movement of the adjustment member 117 with respect to the base plate 115. The adjustment member 117 includes a drive head 213 (see FIGS. 2 and 3) that permits engagement with a tool or other device that is capable of actuating or rotating the adjustment member 117. In one embodiment, drive head 213 is accessible from the top of the railing connector system 100 and may be actuated or driven when railing segments 105 are secured or before railing segments 105 are secured. Drive head 213 is shown as having a hexagonal geometry, but any suitable geometry configuration may be utilized to actuate the adjustment member 117. For example, the drive head 213 may have a square or other polygonal geometry or a Phillips, flat head, star, hex or other drive feature for actuating the adjustment member 117. An upper washer 215 that lubricates or otherwise permits rotation between lift feature 119 and lift surface 209 may be provided between the drive head 213 and the receiver support feature 201. Rotation of the adjustment member 117 results in the adjustment member 117 advancing or retracting through base plate 115 due to the threading therebetween. Adjustment member 117 further includes a lift feature 119 located at a fixed location along the length of the adjustment member 117. Lift feature 119 may be a jam nut, clamp, cotter pin, roll pin, locking mechanism or other securing feature that permits positioning and locking of the lift feature 119 along the length of the adjustment member 117 in its fixed position. The location feature 119 can be altered to provide a desired amount of lift to the pedestal member 111, but during operation remains fixed along the length of the adjustment member 117. Actuation of the adjustment member 117 increases or decreases the distance between the lift feature 119 and the base plate 115 to lower or raise the pedestal member 111. For example, as the adjustment member 117 is rotated and moves with respect to base plate 115, lift feature 119 engages lift surface 209 of the pedestal member 111 and moves the lift surface 209 either away from the base plate 115 or toward base plate 115 depending on the direction of rotation of the adjustment member 117. As shown in FIGS. 1 and 2, the base plate 115 is set at a distance from the post connector 113 by standoff members 121. The specific length and configuration of standoff members 121 are not particularly limited and may include any configuration that retains the positioning of the base plate 115 with respect to the post connector 113. Further, the length of standoff members 121 may be selected to correspond to the amount of height adjustment permitted by the movement of adjustment member 117. Further, the length and configuration of the standoff members 121 may correspond to various configurations of support member 101. Although the embodiment shown includes a post connector 113 having features that engage the interior surface of support member 101, the post connector 113 is not so limited and may include other configurations that attach or otherwise engage with the support member 101. For example, post connector 113 may include features that engage the exterior surface of the support member 101 or have or receive fasteners, adhesive or other attachment mechanisms that engage or attach to the support member 101. Lift feature 119 may also include a lower washer 217 that lubricates or otherwise permits rotation between lift feature 119 and lift surface 209. Upper washer 215 and lower washer 217 may be fabricated from any suitable material, including, but not limited to metal or polymer. In one embodiment, as shown for example in FIG. 2, the positioning of the lift feature 119 and, optionally, the lower washer 217, at one end of the adjustment member 117 and the drive head 213 and, optionally, the upper washer 215 at a distal end 211 is such that the drive head 213 is retained against slot 303 to provide the pivotable engagement and restrict movement of the pedestal member 111 within the segment connector 109. The engagement of the lift surface 209 and the lift feature 119 or the lift feature 119 and the lower washer 217. In another embodiment of the present disclosure, the adjustment member 117 may be a rack and pinion arrangement that may be actuated to adjust the height of the receiver 103. In still another embodiment, the adjustment member 117 may be a rack form that is actuated by rotating or locking into a key to secure a height of the receiver 103.

Figure 4:
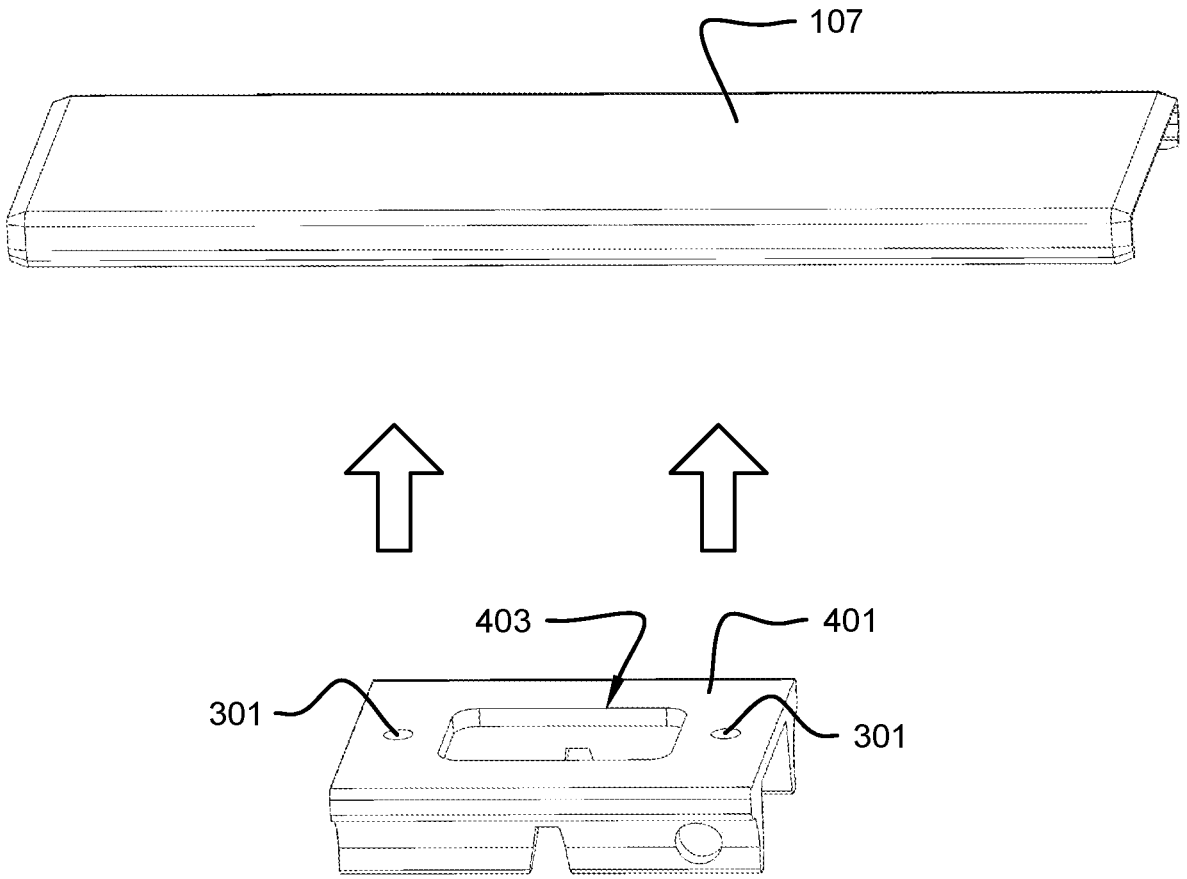
FIG. 4 shows a perspective view of a cap and guide member of the railing connector system according to the present disclosure.

FIG. 4 shows cap 107 with guide member 401. Guide member 401 is configured to fit above railing segments 105 when installed into segment connector 109. Guide member 401 includes fastener openings 301 that, when positioned above the railing segments 105, may be secured with fasteners, such as screws, driven through fastener openings 301. In addition, guide member 401 includes a drive head opening 403 that provides clearance for drive head 213 when cap 107 is positioned on the segment connector 109. Guide member 401 may include a lip or other mechanical feature that clips or otherwise retains the cap 107 onto the guide member 401. Guide member 401 may be fabricated any suitable material. For example, guide member 401 may be fabricated from wood, composite, polymer, aluminum, steel, or zinc. Guide member 401 may be fabricated from the same or different material than the segment connector 109. Likewise, cap 107 may be fabricated any suitable material. For example, cap 107 may be fabricated from wood, composite, polymer, aluminum, steel, or zinc. Cap 107 may be fabricated from the same or different material than the segment connector 109.

Figure 5:
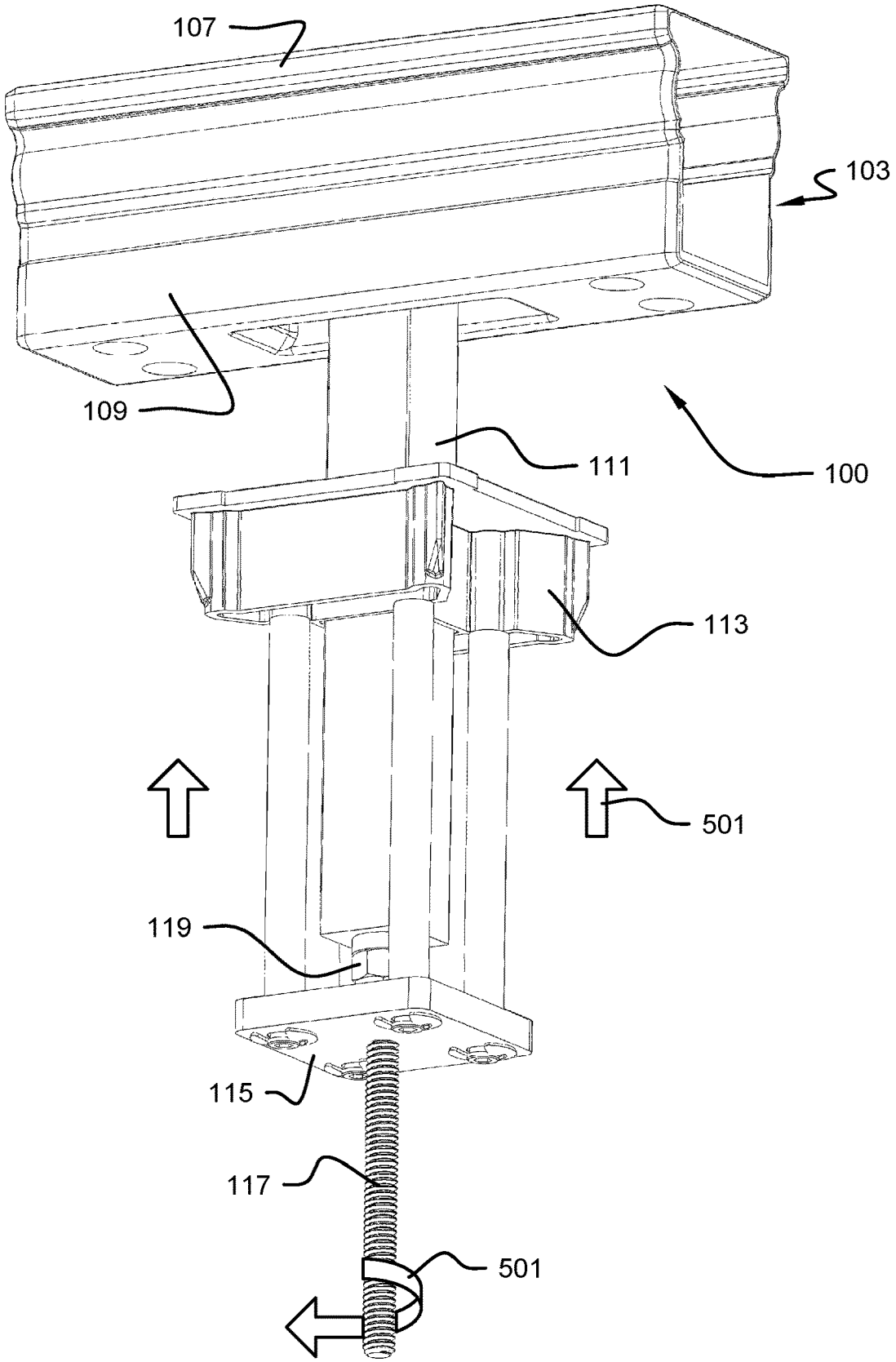
FIG. 5 shows a perspective view of the railing connector system shown in FIG. 1 in a lowered position.
Figure 6:
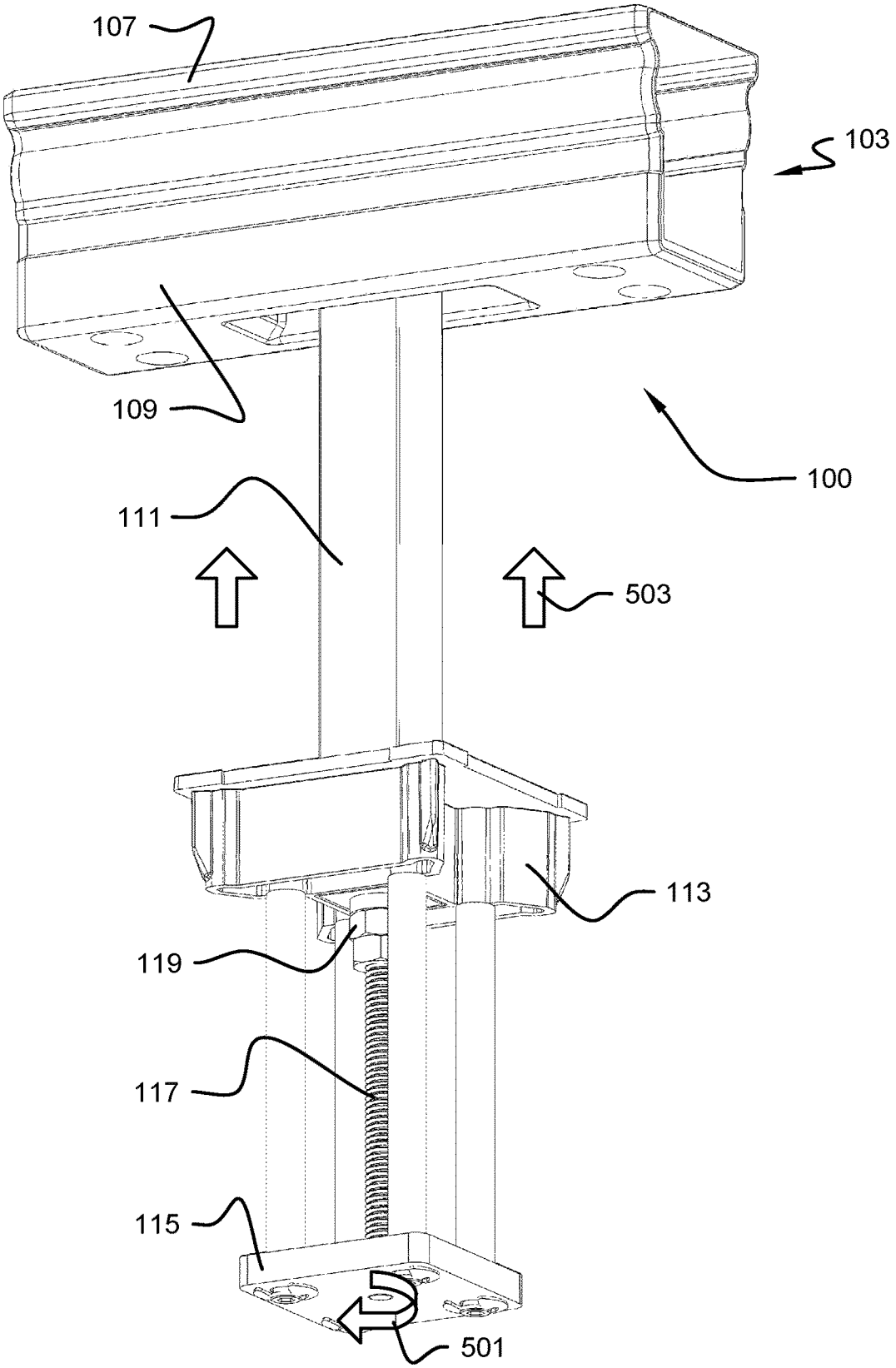
FIG. 6 shows a perspective view of the railing connector system shown in FIG. 1 in a raised position.

FIG. 5 shows a railing connector system 100 according to the present disclosure in a lowered position. As shown in FIG. 5, the adjustment member 117 is rotated in rotational direction 501 that results in a driving of the adjustment member 117 through the base plate 115 via the threaded engagement between the adjustment member 117 and the base plate 115. The pedestal member 111 slides within post connector 113 and raises the receiver 103 in lift direction 503. FIG. 6 shows the railing connector system 100 of FIG. 5, in a raised position. The rotation of the adjustment member 117 in rotational direction 501 may be continued as long at the adjustment member 117 is in threaded engagement with base plate 115. Although FIGS. 5 and 6 show the receiver 103 in a lowered and raised position, respectively, the receiver 103 may be advanced to any position where the adjustment member 117 and the base plate 115 are in threaded engagement. Likewise, rotation in a direction opposite of rotational direction 501 would result in motion of the adjustment member 117 in the opposite direction to lower the receiver 103.

Figure 7:
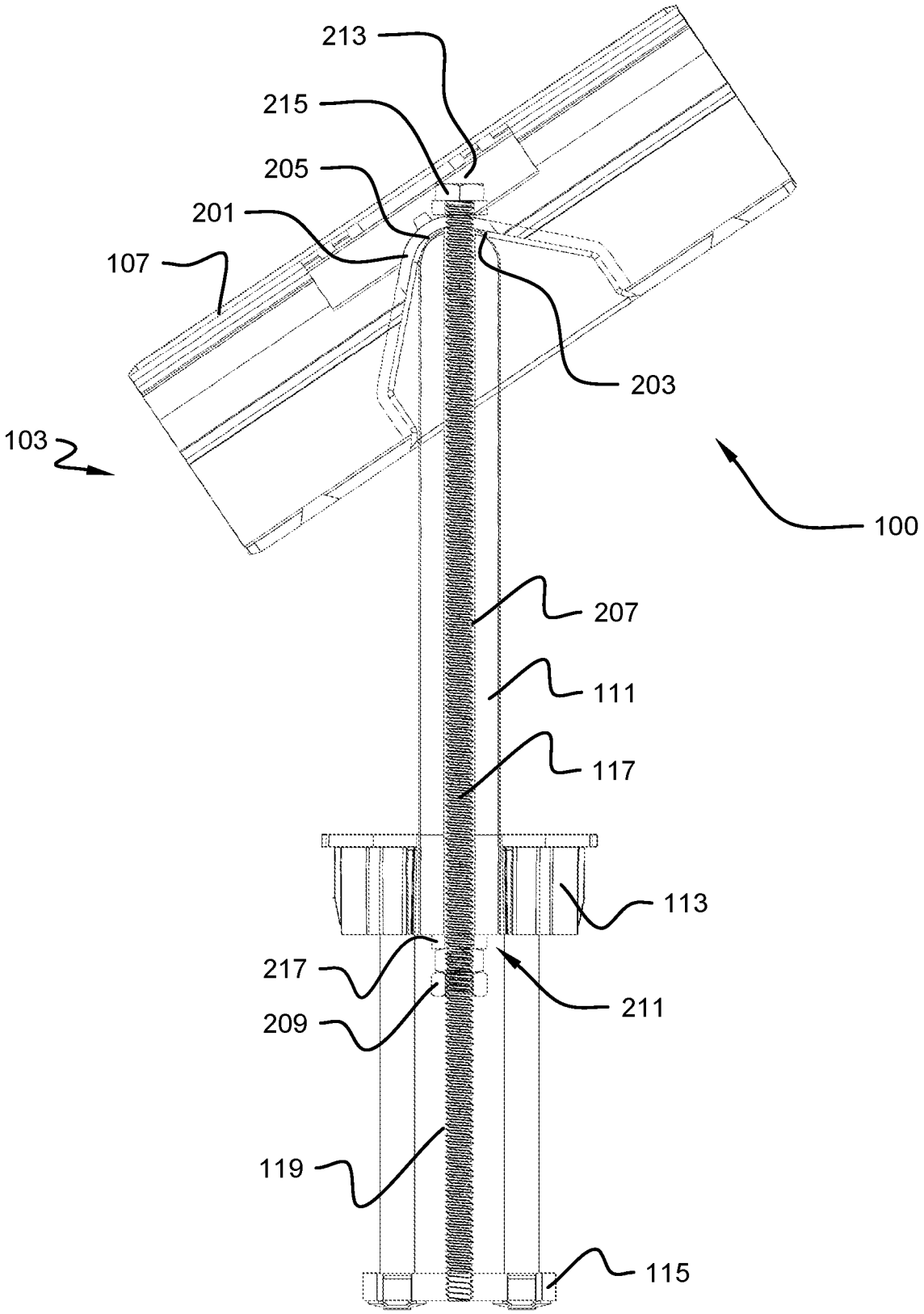
FIG. 7 shows a cutaway view of a railing connector system of FIG. 1 taken in direction 2-2 according to the present disclosure in a pivoted position.

FIG. 7 shows a railing connector system 100 according to an embodiment of the present disclosure in a pivoted position. As shown, pedestal member 111 and receiver 103 are at angles to one another. The support surface 203 of receiver support feature 201 pivotably engage pivot surface 205 of pedestal member 111. The engagement between pivot surface 205 and the support surface 203 is such that the receiver 103 is retained in position and the pedestal member 111 is not permitted to move. Further support for the receiver 103 is provided upon positioning and securing of the railing segments 105 into the segment connector 109 (see FIG. 1). Although FIG. 7 shows the receiver 103 at a particular angle, the receiver 103 may be positioned at any angle permitted from the mechanical pivoting between pedestal member 111 and receiver 103.

Figure 8:
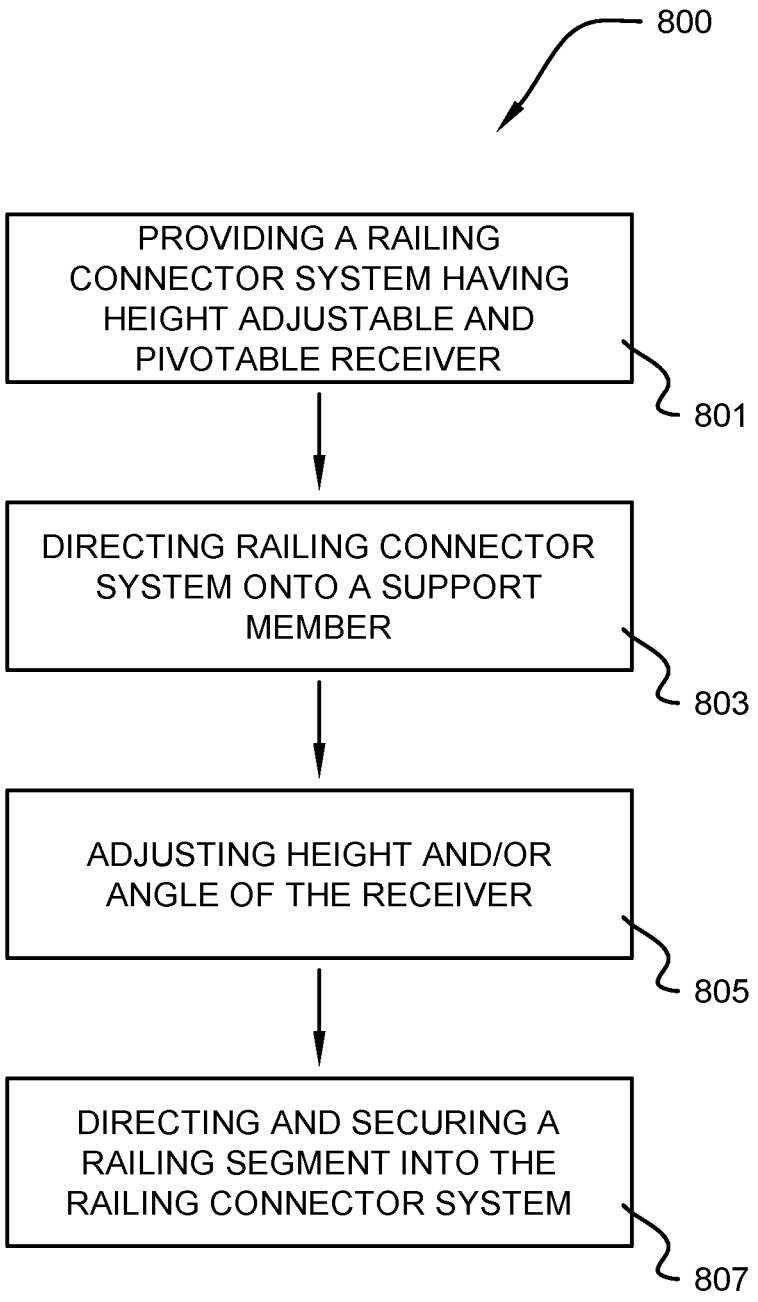
FIG. 8 shows a method according to an embodiment of the present disclosure.

FIG. 8 shows a method for installing railing according to an embodiment of the present disclosure. Method 800 includes providing a railing connector system 100 having a height adjustable and pivotable receiver 103 (step 801). The receiver 103 includes a geometry that permits installation and securing of railing segments 105. The railing connector system 100 is directed onto a support member 101 (step 803). The directing may include attaching or otherwise engaging the railing connector system 100 to the support member 101 via a post connector 113 or other suitable connection device. Once the railing system is directed on the support member 101, the height and/or angle of the receiver is adjusted (step 805). The height adjustment of the receiver 103 may be provided by a pedestal member 111 that is driven by an adjustment member 117. The pivoting of the receiver 103 may be facilitated by a pivotable engagement between the pedestal member 111 and the receiver 103. To provide the pivoting adjustment, the receiver 103 may be manually pivoted to the desired angle, where the pedestal member 111 and the receiver 103 remain in engagement. After the receiver 103 is positioned in the desired angle and/height, one or more railing segments 105 are directed and secured into receiver 103 (step 807). Upon the securing of the railing segments 105, the railing segments provide support to receiver 103 and prevents further pivoting or other motion.

While the exemplary embodiments illustrated in the figures and described herein are presently preferred, it should be understood that these embodiments are offered by way of example only. Accordingly, the present application is not limited to a particular embodiment, but extends to various modifications that nevertheless fall within the scope of the appended claims. The order or sequence of any processes or method steps may be varied or re-sequenced according to alternative embodiments.

It is important to note that the construction and arrangement of the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present application. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating conditions and arrangement of the exemplary embodiments without departing from the scope of the present application.

The invention claimed is:

1. A railing connector system comprising:

a receiver configured to receive one or more fence railing segments, the receiver having a support surface that receives a pivot surface disposed at an upper distal end of a pedestal member, the pedestal member being configured to pivotably engage the support surface;

a post connector configured to be received within an upper end of a fence post, the pedestal member coaxially extending through a central aperture of the post connector into the post;

a threaded adjustment member coaxially extending through a passageway of the pedestal member;

a base plate having a central aperture threadedly engaged with a lower portion of the adjustment member extending from the pedestal member;

at least one standoff member configured to maintain the base plate at a fixed position relative to the post connector;

wherein the base plate and standoff members are disposed within the post; and a lift feature comprising a securing means positionally located along the length of the adjustment member and adapted to lock the lift feature to the adjustment member, the lift feature being disposed between the post connector and the base plate;

said lift feature engaging a lower distal end of the pedestal member to move the pedestal member;

wherein the adjustment member is rotated to threadably translate the adjustment member through the base plate, to move the lift feature relative thereto and adjust the distance which the pedestal member extends from the post connector and the post.

2. The railing connector system of claim 1, wherein the receiver is configured to receive one or more railing segments from distal ends of the receiver.

3. The railing connector system of claim 1, wherein a lift surface is positioned at the upper distal end of the pedestal member.

4. The railing connector system of claim 1, wherein the securing means of the lift feature is a jam nut, clamp, cotter pin, roll pin, or locking mechanism.

5. The railing connector system of claim 1, wherein each of the support surface and the pivot surface have a geometry that allows pivoting or rotating of the receiver with respect to the pedestal member and restricts motion of the pedestal member within the receiver.

6. The railing connector system of claim 1, wherein the receiver includes a cap that at least partially covers the one or more railing segments.

7. The railing connector system of claim 1, further comprising a guide member that is securable to the one or more railing segments and provides access to the adjustment member.

8. A method for installing a railing comprising:

providing a railing connector system of claim 1;

directing the railing connector system onto a support member;

adjusting one or both of a height or an angle of the receiver; and directing a railing segment into the receiver and securing the railing segment to the receiver.

9. The method of claim 8, wherein the pivoting of the receiver is at a pivotable engagement between the pedestal member and the receiver.

10. The method of claim 8, wherein the securing of the railing segment provides support to the receiver and prevents further pivoting or other motion of the receiver.

11. The method of claim 8, wherein the adjusting includes adjusting both the height and the angle of the receiver.

12. The method of claim 8, wherein said securing means is a jam nut, clamp, cotter pin, roll pin, or locking mechanism.

* * * * *